US009683416B2

(12) United States Patent
Rogers et al.

(10) Patent No.: US 9,683,416 B2
(45) Date of Patent: Jun. 20, 2017

(54) SYSTEM AND METHODS FOR RECOVERING HYDROCARBONS

(71) Applicant: Halliburton Energy Services, Inc., Houston, TX (US)

(72) Inventors: Henry Eugene Rogers, Duncan, OK (US); Earl Don Webb, Wilson, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 501 days.

(21) Appl. No.: 14/259,995

(22) Filed: Apr. 23, 2014

(65) Prior Publication Data

US 2014/0352975 A1 Dec. 4, 2014

Related U.S. Application Data

(60) Provisional application No. 61/829,597, filed on May 31, 2013.

(51) Int. Cl.
*E21B 19/16* (2006.01)
*E21B 17/06* (2006.01)
(Continued)

(52) U.S. Cl.
CPC ..... *E21B 19/16* (2013.01); *E21B 17/06* (2013.01); *E21B 23/04* (2013.01); *E21B 43/10* (2013.01)

(58) Field of Classification Search
CPC ..... E21B 23/04; E21B 17/06
See application file for complete search history.

(56) References Cited

U.S. PATENT DOCUMENTS 5,641,021 A 6/1997 Murray et al.
5,711,375 A 1/1998 Ravi et al.
(Continued)

FOREIGN PATENT DOCUMENTS

CN 201170062 Y 12/2008
EP 2772608 A1 9/2014
RU 2437999 C1 12/2011

OTHER PUBLICATIONS

International Search Report and Written Opinion issued in related Application No. PCT/US2014/035338, mailed Mar. 26, 2015 (11 pages).
(Continued)

*Primary Examiner* — Giovanna C Wright
(74) *Attorney, Agent, or Firm* — John W. Wustenberg; Baker Botts L.L.P.

(57) ABSTRACT

A wellbore servicing method includes positioning a tubing string within a wellbore. The tubing string comprises a lower tubular coupled to an upper tubular via a disconnectable assembly having a lower section connected to the lower tubular and an upper section connected to the upper tubular. The method also includes disconnecting the lower tubular from the upper tubular via the disconnectable assembly. Disconnecting the lower tubular from the upper tubular comprises introducing a releasing member into the upper tubular and conveying the releasing member through the upper tubular to engage the disconnectable assembly. The method also includes retracting the upper tubular upwardly within the wellbore. Upon retracting the upper tubular, the releasing member is retracted along with the upper section of the disconnectable assembly. Also, upon retracting the upper tubular, a route of fluid communication out of the upper tubular is provided.

17 Claims, 4 Drawing Sheets

(51) Int. Cl.
*E21B 23/04* (2006.01)
*E21B 43/10* (2006.01)

(56) References Cited

U.S. PATENT DOCUMENTS

| | | | | |
|---|---|---|---|---|
| 5,787,982 | A * | 8/1998 | Bakke | E21B 23/04 166/242.6 |
| 5,823,273 | A | 10/1998 | Ravi et al. | |
| 5,829,526 | A | 11/1998 | Rogers et al. | |
| 6,082,459 | A | 7/2000 | Rogers et al. | |
| 6,182,766 | B1 | 2/2001 | Rogers et al. | |
| 6,318,472 | B1 | 11/2001 | Rogers et al. | |
| 6,622,798 | B1 | 9/2003 | Rogers et al. | |
| 6,772,835 | B2 | 8/2004 | Rogers et al. | |
| 6,796,377 | B2 | 9/2004 | Butterfield, Jr. et al. | |
| 6,810,958 | B2 | 11/2004 | Szarka et al. | |
| 6,820,695 | B2 | 11/2004 | Stevens et al. | |
| 6,880,636 | B2 | 4/2005 | Rogers et al. | |
| 6,896,051 | B2 | 5/2005 | Webb et al. | |
| 6,957,704 | B2 | 10/2005 | Rogers et al. | |
| 6,976,507 | B1 | 12/2005 | Webb et al. | |
| 6,997,253 | B2 | 2/2006 | Webb et al. | |
| 7,080,687 | B2 | 7/2006 | Butterfield, Jr. et al. | |
| 7,108,068 | B2 | 9/2006 | Stevens et al. | |
| 7,204,304 | B2 | 4/2007 | Rogers et al. | |
| 7,225,871 | B2 | 6/2007 | Rogers et al. | |
| 7,252,147 | B2 | 8/2007 | Badalamenti et al. | |
| 7,255,162 | B2 | 8/2007 | Stevens et al. | |
| 7,284,608 | B2 | 10/2007 | Reddy et al. | |
| 7,290,611 | B2 | 11/2007 | Badalamenti et al. | |
| 7,290,612 | B2 | 11/2007 | Rogers et al. | |
| 7,303,008 | B2 | 12/2007 | Badalamenti et al. | |
| 7,303,014 | B2 | 12/2007 | Reddy et al. | |
| 7,322,412 | B2 | 1/2008 | Badalamenti et al. | |
| 7,322,413 | B2 | 1/2008 | Rogers et al. | |
| 7,322,432 | B2 | 1/2008 | Rogers et al. | |
| 7,350,578 | B2 | 4/2008 | Szarka et al. | |
| 7,357,181 | B2 | 4/2008 | Webb et al. | |
| 7,389,815 | B2 | 6/2008 | Badalamenti et al. | |
| 7,401,646 | B2 | 7/2008 | Badalamenti et al. | |
| 7,404,440 | B2 | 7/2008 | Reddy et al. | |
| 7,409,991 | B2 | 8/2008 | Reddy et al. | |
| 7,451,817 | B2 | 11/2008 | Reddy et al. | |
| 7,472,752 | B2 | 1/2009 | Rogers et al. | |
| 7,503,399 | B2 | 3/2009 | Badalamenti et al. | |
| 7,533,729 | B2 | 5/2009 | Rogers et al. | |
| 7,549,475 | B2 | 6/2009 | Tjorswaag et al. | |
| 7,621,336 | B2 | 11/2009 | Badalamenti et al. | |
| 7,621,337 | B2 | 11/2009 | Badalamenti et al. | |
| 7,648,179 | B2 | 1/2010 | Webb et al. | |
| 7,665,520 | B2 | 2/2010 | Szarka et al. | |
| 7,673,688 | B1 | 3/2010 | Jones et al. | |
| 7,694,732 | B2 | 4/2010 | Rogers et al. | |
| 7,735,555 | B2 * | 6/2010 | Patel | E21B 17/028 166/227 |
| 7,841,417 | B2 | 11/2010 | Allison et al. | |
| 7,866,392 | B2 | 1/2011 | Rogers et al. | |
| 7,938,186 | B1 | 5/2011 | Badalamenti et al. | |
| 8,127,859 | B2 | 3/2012 | Allison et al. | |
| 8,230,926 | B2 | 7/2012 | Rogers et al. | |
| 8,267,174 | B2 | 9/2012 | Rogers et al. | |
| 8,276,665 | B2 | 10/2012 | Webb et al. | |
| 8,381,808 | B2 | 2/2013 | Rogers et al. | |
| 2004/0040709 | A1 | 3/2004 | Rogers | |
| 2008/0011482 | A1 | 1/2008 | Badalamenti et al. | |
| 2008/0190613 | A1 | 8/2008 | Tjorswaag et al. | |
| 2011/0120714 | A1 | 5/2011 | Webb et al. | |
| 2011/0214861 | A1 | 9/2011 | Rogers et al. | |
| 2012/0217021 | A1 * | 8/2012 | Cravatte | E21B 34/14 166/373 |
| 2012/0298380 | A1 | 11/2012 | Rogers et al. | |
| 2014/0110129 | A1 * | 4/2014 | Schmidt | E21B 17/06 166/377 |

OTHER PUBLICATIONS

International Preliminary Report on Patentability issued in related Application No. PCT/US2014/035338, mailed Dec. 10, 2015 (7 pages).

Search Report issued in related Australian Application No. 2014272187, mailed Feb. 9, 2016 (3 pages).

Filing receipt and specification for provisional patent application entitled "System and Methods for Recovering Hydrocarbons," by Henry Eugene Rogers, et al., filed May 31, 2013 as U.S. Appl. No. 61/829,597.

* cited by examiner

SYSTEM AND METHODS FOR RECOVERING HYDROCARBONS

CROSS-REFERENCE TO RELATED APPLICATIONS

This application is a non-provisional application and claims priority to U.S. Provisional Application No. 61/829,597 filed May 31, 2013 by Rogers, et al., entitled "System and Method for Recovering Hydrocarbons," which is incorporated herein by reference in its entirety, for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are sometimes drilled into subterranean formations containing hydrocarbons, for example, to allow for the recovery of hydrocarbons from the subterranean formation. Conventionally, various wellbore tubulars may be conveyed into the wellbore for various purposes, such as drilling the wellbore, servicing the wellbore, producing the hydrocarbons from the wellbore, or combinations thereof. For example, a wellbore casing string may be positioned, and in some cases secured, within a wellbore, for example, so as to ensure the wellbore against collapse. Such a casing string may be run into a wellbore, for example, suspended from a work string and decoupled from the work string so as to allow at least a portion of the wellbore tubular (e.g., the casing string) to remain in a particular portion or section of the wellbore, such as a section of the wellbore penetrating a coal seam. For example, a wellbore tubular (e.g., a casing string) may be decoupled from a work string so as to remain within a section of the wellbore so as to provide structural support for a horizontal wellbore, repair a section of another wellbore tubular (e.g., another casing string), provide a route of fluid communication for the production of hydrocarbons (such as methane gas, from a wellbore penetrating a coal bed), or combinations thereof. However, conventional apparatuses, systems, and methods utilized to position such wellbore tubulars suffer from various shortcomings. As such, there is a need for improved apparatuses, systems, and methods that may be suitably employed to deploy a wellbore tubular within a wellbore.

SUMMARY

Disclosed herein is a wellbore servicing method comprising positioning a wellbore tubing string within a wellbore, wherein the wellbore tubing string comprises a lower wellbore tubular coupled to an upper wellbore tubular via a disconnectable assembly having a lower section connected to the lower wellbore tubular and an upper section connected to the upper wellbore tubular, disconnecting the lower wellbore tubular from the upper wellbore tubular via the disconnectable assembly, wherein disconnecting the lower wellbore tubular from the upper wellbore tubular comprises introducing a releasing member into the upper wellbore tubular, and conveying the releasing member through the upper wellbore tubular to engage the disconnectable assembly; and retracting the upper wellbore tubular upwardly within the wellbore, wherein upon retracting the upper wellbore tubular, the releasing member is retracted along with the upper section of the disconnectable assembly, and wherein upon retracting the upper wellbore tubular, a route of fluid communication out of the upper wellbore tubular is provided.

Also disclosed herein is a wellbore connection system comprising a first wellbore tubular, a second wellbore tubular, a disconnectable assembly comprising a lower section, wherein the upper section is coupled to the first wellbore tubular, and an upper section, wherein the upper section is coupled to the second wellbore tubular, and wherein the lower section is selectively, disconnectably coupled to the upper section, a releasing member configured to uncouple the lower section from the upper section, wherein the disconnectable assembly and/or the releasing member is configured such that upon uncoupling the lower section from the upper section, the releasing member is at least partially retained by the upper section, and wherein the disconnectable assembly and/or the releasing member is configured so as to provide a route of fluid communication upon uncoupling the lower section from the upper section.

Further disclosed herein is a wellbore connection system comprising a first wellbore tubular, the first wellbore tubular disposed in an upper portion of a wellbore, a lower section of a dissconnectable assembly, wherein the lower section is coupled to the first wellbore tubular, and a second wellbore tubular, the second wellbore tubular disposed in an upper portion of the wellbore, an upper section of the disconnectable assembly, wherein the upper section is coupled to the second wellbore tubular, and a releasing member, wherein the releasing member is at least partially retained by the upper section of the disconnectable assembly.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
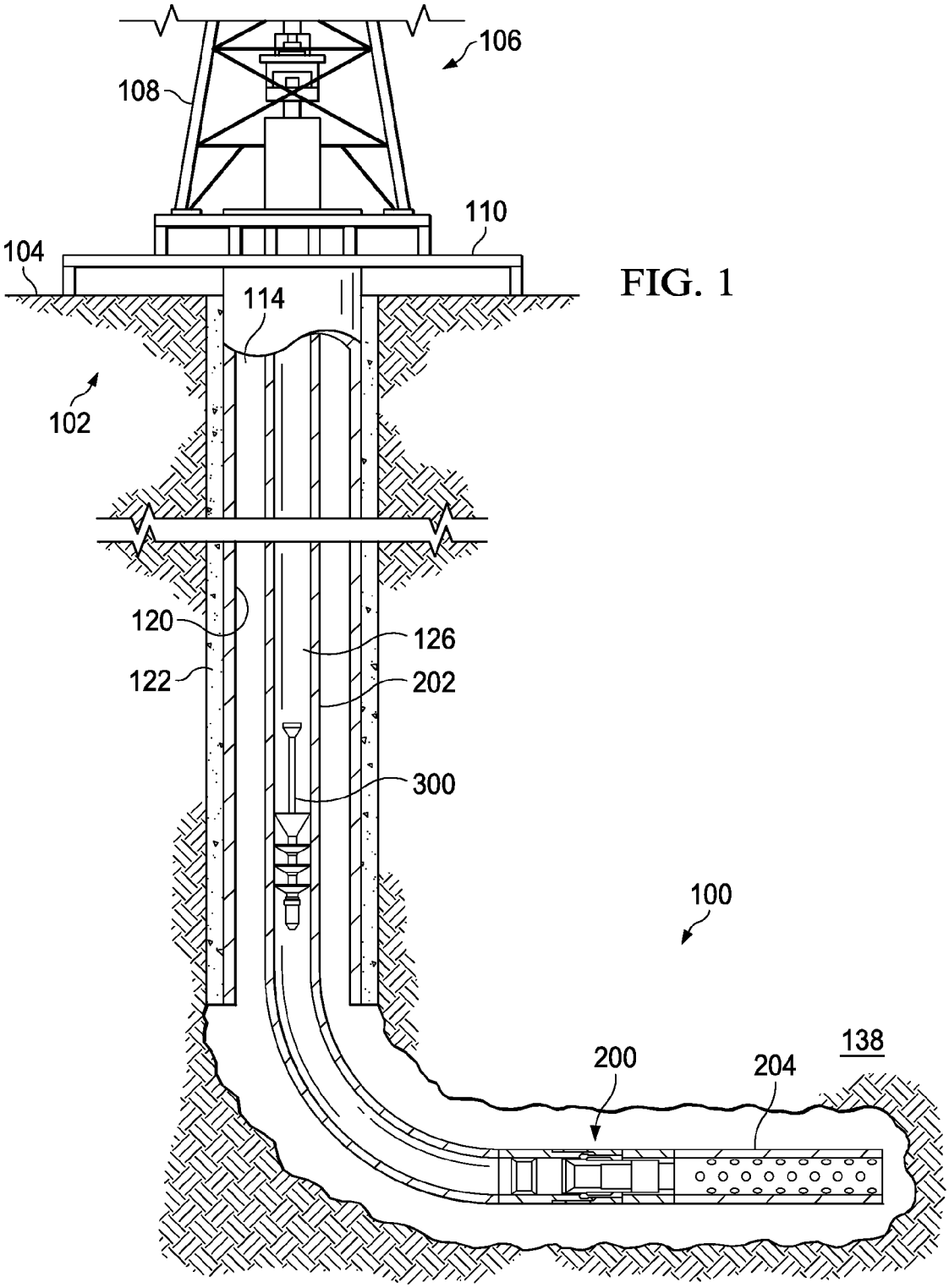
FIG. 1 is a partial cut-away view of an embodiment of an operating environment for a disconnectable connection assembly.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of wellbore servicing apparatuses, systems, and methods of using the same. Particularly disclosed herein are one or more embodiments of a disconnectable connection assembly (DCA), as well as systems and methods of utilizing and/or employing the same. In one or more embodiments, as will be disclosed herein, the DCA may generally be configured to selectively, axially couple two tubular strings. For example, in an embodiment as will be disclosed herein, a DCA may be configured to couple a first tubular string (e.g., casing string) and a second tubular string (e.g., a work string) such that the casing string may be run into a wellbore suspended from the work string. The DCA may also be configured such that the casing string may be disconnected from the work string, for example, without leaving an obturating member disposed within the casing (e.g., so as to not block any portion of the casing string) and/or while providing a flow path out of the work string, for example, during removal of the work string from the wellbore.

Referring to FIG. 1, an example of an operating environment in which such a DCA and/or a system comprising such a DCA may be employed is illustrated. As depicted in FIG. 1, the operating environment generally comprises a wellbore 114 that penetrates a subterranean formation 102 for the purpose of recovering hydrocarbons, storing hydrocarbons, disposing of carbon dioxide, or the like. The wellbore 114 may be drilled into the subterranean formation 102 using any suitable drilling technique. In an embodiment, a drilling or servicing rig 106 disposed at the surface 104 comprises a derrick 108 with a rig floor 110 through which various tubular strings, (e.g., a work string, such as a drill string, a tool string, a segmented tubing string, a jointed tubing string, a casing string, or any other suitable conveyance, or combinations thereof) generally defining an axial flow bore may be positioned within or partially within wellbore 114. In an embodiment, such a tubular string may comprise two or more concentrically positioned strings of pipe or tubing (e.g., a first work string may be positioned within a second work string). The drilling or servicing rig may be conventional and may comprise a motor driven winch and other associated equipment for lowering the tubular string(s) into wellbore 114. Alternatively, a mobile workover rig, a wellbore servicing unit (e.g., coiled tubing units), or the like may be used to lower the tubular string into the wellbore 114. In such an embodiment, the tubular string(s) may be utilized in drilling, stimulating, completing, or otherwise servicing the wellbore, or combinations thereof.

The wellbore 114 may extend substantially vertically away from the earth's surface over a vertical wellbore portion, or may deviate at any angle from the earth's surface 104 over a deviated or horizontal wellbore portion. For example, in an embodiment, the horizontal wellbore portion may penetrate a subterranean formation zone, such as a coal seam 138, as shown in FIG. 1, for example, for the purpose of extracting methane gas present within the coal seam 138. In alternative operating environments, portions or substantially all of wellbore 114 may be vertical, deviated, horizontal, and/or curved. In some embodiments, at least a portion of the wellbore 114 may be lined with a casing 120 that is secured into position against the formation 102 in a conventional manner using cement 122. In alternative operating environments, the wellbore 114 may be partially cased and cemented thereby resulting in a portion of the wellbore 114 being uncased. In an embodiment, a portion of wellbore 114 may be cased and may remain uncemented, but may employ one or more packers (e.g., mechanical and/or swellable packers, such as Swellpackers™, commercially available from Halliburton Energy Services, Inc.) to isolate two or more adjacent portions or zones within wellbore 114. Alternatively, portions or substantially all of the wellbore 114 may be uncased and/or uncemented. It is noted that although some of the figures may exemplify a horizontal or vertical wellbore, the principles of the system, apparatuses, and methods disclosed may be similarly applicable to horizontal wellbore configurations, conventional vertical wellbore configurations, new wellbores, existing wellbores, straight wellbores, extended reach wellbores, sidetracked wellbores, multi-lateral wellbores, other types of wellbores for drilling and completing one or more production zones, or combinations thereof. Therefore, the horizontal or vertical nature of any figure is not to be construed as limiting the wellbore to any particular configuration.

Referring to FIG. 1, a wellbore disconnect system 100 is illustrated positioned within the wellbore 114. In the embodiment of FIG. 1, the wellbore disconnect system 100 generally comprises a wellbore tubing string, particularly, a first wellbore tubing string selectively coupled to a second wellbore tubing string via a DCA 200. For example, in the embodiment of FIG. 1, the wellbore servicing system 100 comprises a casing string 204 releasably suspended from a work string 202 by the DCA 200. In such an embodiment, the casing string 204 may be coupled to the work string 202 via the DCA, for example, at a position relatively downhole from the work string 202. Also, in such an embodiment, the work string 202 may be positioned within the wellbore 114 such that the casing string 204 is and/or may be positioned at a desired, predetermined depth within the wellbore 114, for example, proximate and/or substantially adjacent to one or more zones of the subterranean formation 102, for example, within a coal seam 138. While one or more of the embodiments herein may disclose the DCA 200 with reference to a casing string and/or to a work string (e.g., the casing string 204, which is run into the wellbore 114 suspended from the work string 202), in additional or alternative embodiments, a DCA (such as DCA 200, which is disclosed herein) may be similarly employed to releasably couple any suitable first wellbore tubular and/or wellbore tool to any other suitable second wellbore tubular; as such, this disclosure should not be construed as so-limited. Additionally, in an embodiment the wellbore disconnect system 100 may further comprise a releasing member 300 (e.g., a releasing dart).

In an embodiment, the casing string 204 may be generally configured so as (when positioned within the wellbore 114)

to provide a route of fluid communication through at least a portion of the subterranean formation 102 and/or to maintain the integrity of the wellbore 114, for example, for the production of hydrocarbons. For example, the casing string 204 may be configured to prevent the wellbore 114 (e.g., a horizontal wellbore portion) from collapse. Also, the casing string 204 may be disposed within the wellbore 114 (e.g., within a horizontal wellbore portion) so as to allow one or more formation fluid to be produced therefrom, for example, so as to extract methane gas from a coal seam. The casing string 204 may comprise any suitable type and/or configuration thereof. For example, the casing string 204 may generally comprise a production tubular, such as a jointed tubing string, a coiled tubing string, or combinations thereof. Also, in embodiments, substantially all or portions of the casing string 204 may be perforated or un-perforated. The casing string 204 may be formed from a suitable material, examples of which include but are not limited to, metals and/or metallic alloys, such as aluminum, iron, or steel; synthetic materials, such as plastics; composite materials, such as fiberglass; any other suitable material as will be appreciated by one of ordinary skill in the art upon viewing this disclosure, or combinations thereof.

While one or more of the embodiments of this disclosure may refer to a casing string 204 configured for use in a production operation (e.g., a production string), as disclosed herein, a tubular string may be configured for various additional or alternative operations and, as such, this disclosure should not be construed as limited to utilization in any particular wellbore servicing context unless so-designated. For example, in an embodiment, a tubular string (e.g., like the casing string 204) may be configured for a servicing operation, such as a stimulation operation, a completion operation, a clean-out operation, or combinations thereof. In such an embodiment, such a tubular string may comprise one or more wellbore servicing tools (e.g., perforating, fracturing, and/or the like)

In an embodiment, the work string 202 may be generally configured to deliver the casing string 204 to a desired and/or predetermined location within the wellbore 114. The work string may comprise any suitable type and/or configuration of tubular string. Suitable types/configurations of such a tubular string include, but are not limited to a drill string, a coiled-tubing string, a segmented tubing string, a jointed tubing string, or any other suitable conveyance, or combinations thereof, as may be appropriate for a given operation or environment.

Figure 2A:
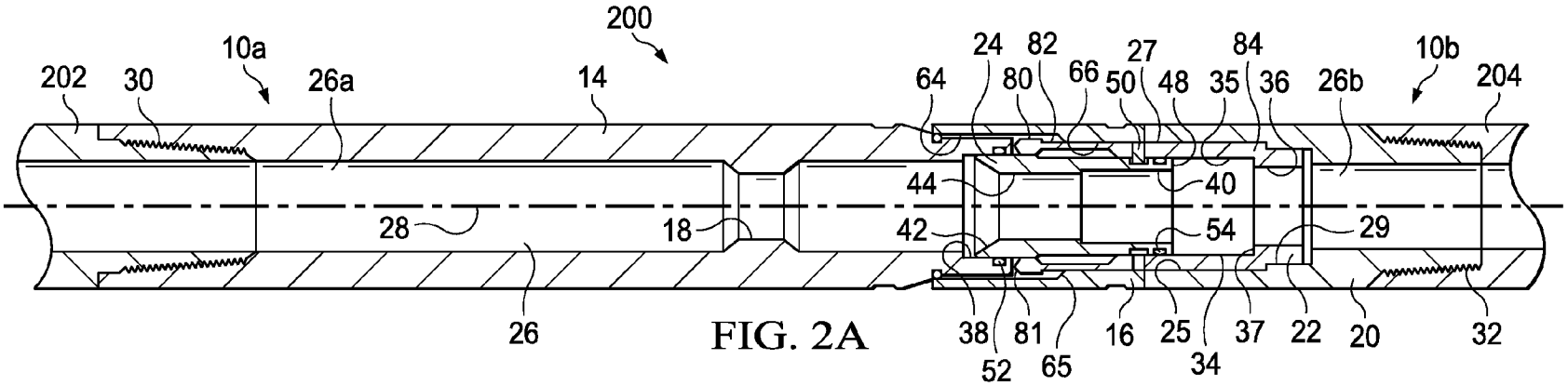
FIGS. 2A, 2B, and 2C are cut-away views of an embodiment of a disconnectable connection assembly.
Figure 2B:
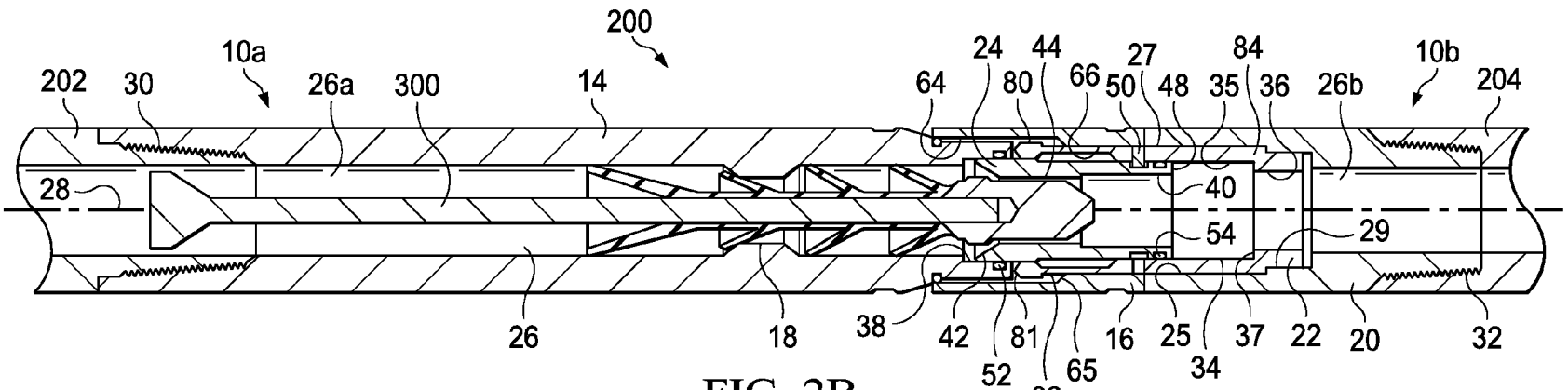
Figure 2C:
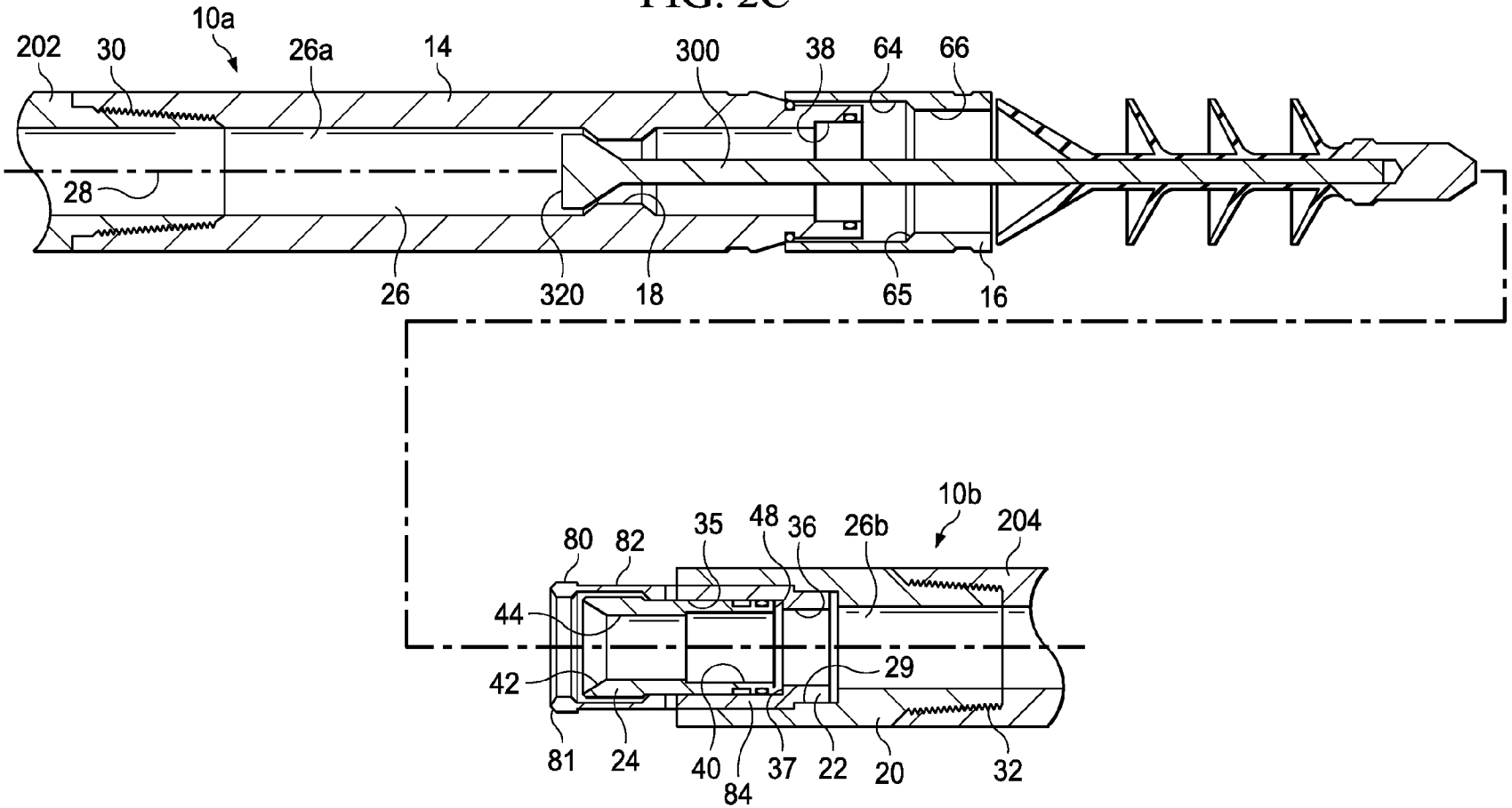

Referring to FIGS. 2A, 2B, and 2C, an embodiment of a DCA 200 is illustrated. In the embodiment of FIGS. 2A, 2B, and 2C, the DCA 200 generally comprises an upper section 10*a* and a lower section 10*b*. Each of the upper section 10*a* and the lower section 10*b* comprises a generally tubular structure, with respect to a longitudinal axis 28, cooperatively defining an axial flowbore 26 extending longitudinally therethrough. In an embodiment, and as will be disclosed herein, the DCA 200 is generally configured such that the upper section 10*a* and the lower section 10*b* may be selectively connected, alternatively, selectively disconnected. For example, FIGS. 2A and 2B illustrate the DCA 200 in a first or "connected" configuration, for example, where the upper section 10*a* and the lower section 10*b* are coupled together (e.g., longitudinally). FIG. 2C illustrates the DCA 200 in a second or "disconnected" configuration where the upper section 10*a* and lower section 10*b* are separated. Additionally, FIG. 2B illustrates the DCA 200 at an intermediate stage, for example, during the decoupling of the lower section 10*b* from the upper section 10*a*, as will be disclosed herein. As will be explained in detail below, the DCA 200 comprises a coupling mechanism configured such that in the connected configuration the coupling mechanism couples (e.g., longitudinally) the upper section 10*a* to the lower section 10*b*, and in the disconnected configuration the coupling mechanism does not couple the upper section 10*a* to the lower section 10*b*, for example, thereby allowing the upper section 10*a* and the lower section 10*b* to be longitudinally separated.

While an embodiment of the DCA 200 is disclosed with respect to FIGS. 2A, 2B, and 2C, one of skill in the art upon viewing this disclosure, will recognize suitable alternative configurations. As such, while embodiments of a DCA may be disclosed with reference to a given configuration (e.g., DCA 200 as will be disclosed with respect to FIGS. 2A, 2B, and 2C), this disclosure should not be construed as limited to such embodiments.

In the embodiment of FIGS. 2A, 2B, and 2C, the upper section 10*a* of the DCA 200 is connected to (e.g., incorporated with) the work string 202; for example, the upper section 10*a* is connected to a lower, terminal end of the work string 202 via a suitable interface (e.g., a threaded connection, as will be disclosed herein). Also in the embodiment of FIGS. 2A, 2B, and 2C, the lower section 10*b* of the DCA 200 is connected to (e.g., incorporated with) the casing string 204; for example, the lower section 10*b* is connected to an upper, terminal end of the casing string 204 via suitable interface (e.g., a threaded connection, as will also be disclosed herein). Alternative, suitable connections may be appreciated by one of skill in the art upon viewing this disclosure. In an embodiment, the DCA 200 may be generally configured such that, when activated (e.g., transitioned from the first, connected configuration to the second, disconnected configuration) as will be disclosed herein, the lower section 10*b* may be selectively released (e.g., decoupled) from the upper section 10*a*, for example, so as to selectively couple or decouple the casing string 204 to/from the work string 202. The individual components of the DCA 206 will now be discussed with reference to FIGS. 2A, 2B, and 2C.

In an embodiment, the upper section 10*a* of the DCA 200 generally comprises an upper housing 14, a collet retainer 16, and a releasing member retainer 18, cooperatively generally defining an upper portion of the axial flowbore 26*a*. In the embodiment of FIGS. 2A, 2B, and 2C, the upper housing 14 and the collet retainer 16 comprise two or more separate, operably coupled components (e.g., coupled via a suitable connected, such as a welded or threaded connection). Also in the embodiment of FIGS. 2A, 2B, and 2C, the upper housing 14 and the releasing member retainer 18 comprise a single, unitary structure. In alternative embodiments, two or more of the upper housing 14, the collet retainer 16, and the releasing member retainer 18 may comprise separate, operably-joined components or may comprise a single, unitary structure.

In an embodiment, the upper housing 14 generally comprises a cylindrical or tube-like structure. In an embodiment, the upper housing 14 may be adapted for connection to the work string 202 (alternatively, to any suitable wellbore tubular) in a suitable manner, as disclosed herein. For example, in an embodiment, the upper housing 14 comprises an internally threaded surface 30 (alternatively, an externally threaded surface) to connect to the work string 202. Additional or alternative suitable connections will be known to those of skill in the art upon viewing this disclosure.

Referring to FIG. 1, the DCA 200 is incorporated within the work string 202 such that the axial flowbore 26 of the DCA 200 is in fluid communication with the axial flowbore 126 of the work string 202. For example, the DCA 200 is incorporated within the work string 202 such that a fluid may be communicated between the axial flowbore 126 of the work string 202 and the axial flowbore 26 of the DCA 200.

Figure 3:
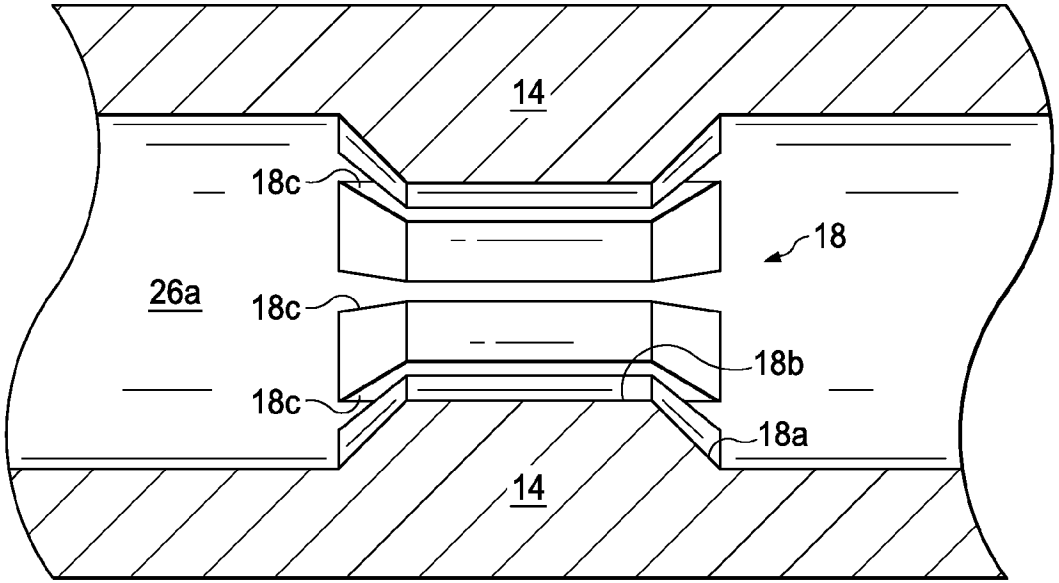
FIG. 3 is a cut-away view of an embodiment of a portion of a disconnectable connection assembly.

Referring to FIG. 3, an embodiment of the releasing member retainer 18 is illustrated. In an embodiment, the releasing member retainer 18 is generally configured to interact with at least a portion of the releasing member 300 so as to retain at least a portion of the releasing member 300 from passing therethrough. In an embodiment, the releasing member retainer 18 generally comprises a narrowing and/or reduction in the inner diameter of the upper portion of the axial flowbore 26*a* (e.g., a choke). For example, in the embodiment of FIG. 3, the releasing member retainer 18 comprises radially inward shoulder or protrusion (alternatively, a plurality of radially inward shoulders or protrusions) within the upper housing 14. In the embodiment of FIG. 3, the diameter of the axial flowbore 26 (e.g., the upper portion of the axial flowbore) narrows at a bevel 18*a* (alternatively, a chamfer, shoulder, or the like) to a bore surface 18*b* having a decreased diameter relative to the diameter of the axial flowbore 26. In such an embodiment, releasing member retainer 18 (e.g., the bevel 18*a* and/or bore surface) may define an inner profile.

In an embodiment, the releasing member retainer 18 may be configured to allow a route of fluid communication from one side of the releasing member retainer 18 (e.g., an uphole side) to the other side of the releasing member retainer 18 (e.g., the downhole side) when the bore 18*b* is blocked or obscured (e.g., by an obturating member, such as a dart, as will be disclosed herein). For example, in the embodiment of FIG. 3, the releasing member retainer 18 comprises one or more slots 18*c* (alternatively, grooves, bores, notches, holes, channels, or the like) extending generally longitudinally through the releasing member retainer 18. For example, where the bore 18*b* extending through the releasing member retainer 18 is blocked (e.g., by the releasing member or a portion thereof, as will be disclosed herein), fluid may be communicated through the slots 18*c*, which may form a fluidic pathway between the uphole and downhole sides of the releasing member retainer 18, as will be disclosed herein.

In an embodiment, the collet retainer 16 is coupled to (alternatively, forms) a lower end of the upper housing 14. In an embodiment, the collet retainer 16 generally comprises a cylindrical or tube-like structure, having a first inner bore surface 64 and a second inner bore surface 66. In the embodiment of FIGS. 2A, 2B, and 2C, the first inner bore surface 64 is generally located above (e.g., uphole from) the second inner bore surface 66 and comprises a relatively greater diameter than the second inner bore surface 66. Also in the embodiment of FIGS. 2A, 2B, and 2C, the first inner bore surface 64 narrows (e.g., radially inward) at a bevel 65 (alternatively, a chamfer, lip, shoulder, seat, or the like) to the second inner bore surface 66. In an embodiment, the first inner bore surface 64, the bevel 65, and/or the second inner bore surface 66 may cooperatively form an inner profile. In an embodiment, at least a portion of the inner profile may be complementary to at least a portion of the lower section (e.g., at least a portion of a collet, as will be disclosed herein).

In an embodiment, the lower section 10*b* of the DCA 200 generally comprises a lower housing 20, a releasing collet 22, and a releasing sleeve 24, cooperatively generally defining a lower portion of the axial flowbore 26*b*. In the embodiment of FIGS. 2A, 2B, and 2C, the lower housing 20 and the releasing collet 22 comprise two or more separate, operably coupled components (e.g., coupled via a suitable connection, such as a welded or threaded connection). In alternative embodiments, the lower housing 20 and the releasing collet 22 may comprise a single, unitary structure.

In an embodiment, the lower housing 20 generally comprises a cylindrical or tube-like structure. In an embodiment, the lower housing 20 may be adapted for connection to the casing string 204 (alternatively, to any suitable wellbore tubular) in a suitable manner, as disclosed herein. For example, in an embodiment, the lower housing 20 comprises an externally threaded surface 32 (alternatively, an internally threaded surface) to connect to the casing string 204. Additional or alternative suitable connections will be known to those of skill in the art upon viewing this disclosure.

Referring to FIG. 1, the DCA 200 is incorporated within the work string 204 such that the axial flowbore 26 of the DCA 200 is in fluid communication with the axial flowbore 126 of the work string 204. For example, the DCA 200 is incorporated within the casing string 204 such that a fluid may be communicated between the axial flowbore 126 of the casing string 204 and the axial flowbore 26 of the DCA 200.

In an embodiment, the lower housing 20 may be configured to house and/or retain the releasing collet 22. For example, in the embodiment of FIGS. 2A, 2B, and 2C, the lower housing 20 comprises a collet recess 25. In such an embodiment, the collet recess 25 may comprise a first inner bore surface 27 and a second bore surface 29, for example, the first bore surface 27 having a diameter greater than the diameter to the second bore surface 29. The collet recess 25 may be generally sized to receive the releasing collet 22 or a portion thereof. Additionally, in an embodiment, the collet recess 25 may be configured to retain the releasing collet. For example, in an embodiment the collet recess 25 (e.g., the first bore surface) may comprise a threaded surface generally configured to interface with the releasing collet 22.

In an embodiment, the releasing collet 22 comprises a generally cylindrically shaped structure. In an embodiment, the releasing collet 22 generally comprises a radially outwardly protruding rim 80, a flexible (or upper) portion 82, and a lower (or base) portion 84. In an embodiment, the outwardly protruding rim extends circumferentially at least partially around an upper end of releasing collet 22. The rim 80 may comprise a diameter generally greater than the diameter of the remainder of the releasing collet 22, for example, narrowing at a generally downwardly-facing bevel 81 or shoulder. In an embodiment, the releasing collet 22 (e.g., the outwardly protruding rim 80) may generally define an outer profile. In an embodiment, at least a portion of the outer profile may be complementary to the at least at portion of the inner profile defined by the first inner bore surface 64, the bevel 65, and/or the second inner bore surface 66 (e.g., of the collet retainer 16, as disclosed herein).

In an embodiment, the flexible portion 82 is located generally downward from the rim 80. In an embodiment, the flexible portion 82 may comprise a wall thickness that is narrow relative to the lower portion 84 of the releasing collet 22. Also, in an embodiment, the releasing collet 22 may comprise a predetermined number of longitudinal slots extending from the top of the rim 80 through the upper flexible portion 82 (e.g., a portion of the longitude of the releasing collet 22), for example, 3, 4, 5, 6, 7, 8, 9, 10, 11, 12, 13, 14, 15, 16, or any suitable number of slots. In an embodiment, the slots may be substantially equally spaced around the periphery of the rim 80 and/or the flexible portion 82. Also, in an embodiment, the slots may radially divide the flexible portion 82 of the releasing collet 22 into a plurality of radially-spaced "fingers" (e.g., collet fingers or cage) or longitudinal protrusions. As will be explained herein, the slots and/or the narrowed wall thickness of the flexible portion 82 may allow the diameter of the rim 80 to vary. For example, the rim 80 can be considered "flexible" in that it can contract from a first radially-expanded configuration (e.g., of a particular diameter) to a second radially-contracted conformation (e.g., of a lesser diameter). For example, the rim 80 may be configured so as to be able to decrease in diameter when the rim 80 is not radially supported (e.g., held in a radially expanded conformation), for example, by a supporting mechanism. Additionally, in an embodiment, the flexible portion 82 (e.g., the collet fingers) may be characterized as exhibiting a bias or spring-like behavior. For example, in an embodiment the flexible portion 82 may be configured so as contract radially (e.g., a radially-inward bias) when not held or retained in a radially expanded configuration.

In an embodiment, the lower portion 84 may be located below the upper flexible portion 82. In an embodiment, the lower portion 84 of the collet 22 may be configured to be joined to the lower housing 20. For example, in an embodiment, the lower section 84 of the collet 22 may comprise an externally threaded surface, for example, to mate with an internally threaded surface of the lower housing 20 and, thereby, couple the collet 22 to and/or within the lower housing 20. Alternatively, in an embodiment the collet 22 and the lower housing 20 may be formed as a single, integrated component.

In an embodiment, the collet 22 may be configured to house the releasing sleeve 24. For example, in the embodiment of FIGS. 2A, 2B, and 2C, the collet 22 may comprise a releasing sleeve recess 34 or a portion thereof. In such an embodiment, the collet 22 may comprise a first inner bore surface 35 and a second bore surface 36, for example, the first bore surface 35 having a diameter greater than the diameter to the second bore surface 36 and being at least partially defined by a shoulder 37 therebetween. In an embodiment, the releasing sleeve recess 34 may be generally sized to receive the releasing sleeve 24 or a portion thereof. For example, the releasing sleeve recess 34 may be generally sized so as to allow the releasing sleeve 24 to slide longitudinally therein, as will be disclosed herein.

Additionally, in an embodiment the releasing sleeve recess 34 may extend (e.g., longitudinally) over at least a portion of the upper housing 18. For example, in the embodiment of FIGS. 2A, 2B, and 2C, the releasing sleeve recess 34 extends to the upper housing 18. In the embodiment of FIGS. 2A, 2B, and 2C, the upper housing 18 comprises a bore surface 38 having a diameter substantially the same as the diameter of the first inner bore surface 35 and adjacent thereto.

In an embodiment, the releasing sleeve 24 may comprise a generally cylindrical structure generally defining a concentric bore 40 which runs along the longitudinal axis of the releasing sleeve 24. In an embodiment, the exterior diameter of the releasing sleeve 24 may be slightly smaller than the inner diameter of the releasing sleeve recess 34 of the collet 22. In an embodiment, the releasing sleeve 24 may be configured to engage an obturating member of a given size and/or configuration (e.g., a dart, such as the releasing member 300, as will be disclosed herein). For example, in the embodiment of FIGS. 2A, 2B, and 2C, the releasing sleeve 24 comprises a radially inwardly beveled surface 42 generally defining a relatively narrowed bore 44 within the concentric bore 40 of the releasing sleeve 24, for example, at the relatively upper end thereof. In such an embodiment, the narrow bore 44 generally forms a portion of the concentric bore 40.

In an embodiment, the releasing sleeve 24 may be slidably disposed within the releasing sleeve recess 34. For example, in the embodiment of FIGS. 2A, 2B, and 2C, depending upon the position of the releasing sleeve 24, the releasing sleeve 24 is slidably disposed such that a portion of the releasing sleeve 24 is disposed against (e.g., interfaces with) a portion of the upper housing and/or such that a portion of the releasing sleeve 24 is disposed against (e.g., interfaces with) a portion of the collet 22. In such an embodiment, the bore 40 of the releasing sleeve 24 may be in fluid communication with the concentric bore 26 (for example, forming a portion of the concentric bore 26 and/or the lower portion 26*b* thereof).

In an embodiment, the releasing sleeve 24 may be slidably movable between a first position and a second position. Referring to the embodiment of FIG. 2A, the releasing sleeve 24 is illustrated in the first position. In the first position, the releasing sleeve 24 "radially supports" the collet 22 (e.g., the rim 80 and/or flexible portion 82 of the collet in an expanded conformation), for example, in that the releasing sleeve 24 prevents the rim 80 from radially contracting to a relatively smaller diameter. For example, in the first position, the releasing sleeve 24 retains (e.g., holds) the rim 80 in the first, radially expanded conformation, for example, thereby prohibiting the upper, flexible portion 82 of the collet 22 from flexing inwardly. Also, in the second position, the releasing sleeve 24 does not radially support the rim 80. For example, in the second position, the releasing sleeve 24 does not retain or otherwise hold the rim 80 in the first, radially expanded conformation. For example, when the releasing sleeve is in the second position, the rim 80 is allowed to move inwardly from the first, radially expanded configuration to the second, radially contracted configuration, for example, via the flexing of the upper flexible portion of the collet 22.

In an embodiment, the releasing sleeve 24 may be maintained in the first position by a positioning mechanism, such as a shearing mechanism. For example, in the embodiment of FIG. 2A, the shearing mechanism comprises a one or more frangible members (e.g., a plurality of radially-spaced frangible members), such as one or more shear pins 50 which may extend through the releasing sleeve 24 and the collet 22. In an embodiment, the shear mechanism may actuate (e.g., break, shear) upon the application of a predetermined force, for example, which may be applied upon the longitudinal movement of the releasing sleeve 24. As will be explained below in relation to the operation of the DCA 200, once the one or more shear pins 50 have sheared (e.g., disabling the positioning mechanism), the releasing sleeve 24 may be free to slidably move (e.g., downward, along the longitudinal axis 28 to the second position). In an alternative embodiment, the shearing mechanism may comprise a shearing ring, which may similarly actuate (e.g., break, shear) upon the application of a predetermined force, as will also be disclosed herein. One of ordinary skill in the art, upon viewing this disclosure, will appreciate various, suitable embodiments by which a collet may be held in a particular position.

In an embodiment, the releasing sleeve 24 may be configured such that one or more of the interfaces between the releasing sleeve 24 and the collet 22 and/or between the releasing sleeve 24 and the upper housing 18 may be substantially fluid-tight. For example, in an embodiment, the releasing sleeve, the upper housing 18, the collet 22, or combinations thereof, may comprise a suitable fluid seal at one or more of the interface between the releasing sleeve 24 and the upper housing 18 and/or the interface between the releasing sleeve 24 and the collet 22. In the embodiment of FIGS. 2A, 2B, and 2C, depending upon the position of the releasing sleeve 24, a first fluid seal 52 may be present at the interface between the releasing sleeve 24 and the upper housing 18 and a second fluid seal 54 may be present at the interface between the releasing sleeve 24 and the collet 22. In such an embodiment, the first and second fluid seals, 52 and 54, respectively, may be configured to prohibit fluid communication via the interface between the releasing sleeve 24 and the upper housing 18 and the interface between the releasing sleeve 24 and the collet 22, for example, such that fluid is prohibited from escaping from the DCA 200 (e.g., via the joint between the upper section 10*a* and the lower section 10*b*.

In an embodiment, the upper section 10*a* and the lower section 10*b* may be selectively coupled. For example, referring to FIG. 2A, the collet 22 (e.g., of the lower section 10*b*), which is held in the first, radially expanded conformation by the releasing sleeve 24 (which is in the first, longitudinal position), engages the collet retainer 16 (e.g., of the upper section 10*a*), for example, so as to retain the lower section 10*b* in relationship to the upper section 10*a*. Particularly, in the embodiment of FIG. 2A, the outwardly protruding rim 80 and/or the downward facing shoulder 81 of the collet 22 (e.g., the outer profile of the releasing collet 22) engage the first inner bore surface 64 and/or the bevel 65 of the collet retainer 16 (e.g., the inner profile of the collet retainer 16). In such an embodiment, where the releasing sleeve 24 is in the first position, as disclosed herein, the releasing collet 22 may be prohibited from contracting to the radially inward conformation and, as such, may be prohibited from disengaging the collet retainer 16, thereby coupling the lower section 10*b* to the upper section 10*a* of the DCA 200.

Also, in an embodiment, the upper section 10*a* and the lower section 10*b* may be configured so as to be selectively decoupled (e.g., uncoupled via the operation of the releasing member, as will be disclosed herein). For example, referring to FIG. 2C, the collet 22 (e.g., of the lower section 10*b*), which is not held in the first, radially expanded conformation by the releasing sleeve (which is in the second longitudinal position), is allowed to disengage the collet retainer 16 (e.g., of the lower section 10*b*), for example, so as to allow the lower section 10*b* to be uncoupled from the upper section 10*a*. Particularly, in the embodiment of FIG. 2C, the outwardly protruding rim 80 and/or the downward facing shoulder 81 of the collet 22 (e.g., the outer profile of the releasing collet 22) are allowed to disengage the first inner bore surface 64 and/or the bevel 65 of the collet retainer 16 (e.g., the inner profile of the collet retainer 16). In such an embodiment, where the releasing sleeve 24 is in the second position, as disclosed herein, the releasing collet is allowed to contract (e.g., flex inwardly) to the radially inward conformation and, as such, to disengage the collet retainer 16, thereby uncoupling the lower section 10*b* from the upper section 10*a* of the DCA 200.

Figure 4:
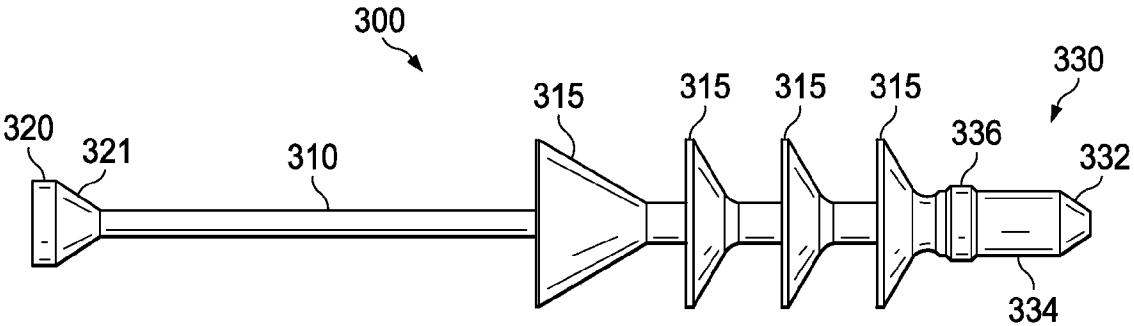
FIG. 4 is an illustration of an embodiment of a releasing member.

In an embodiment, the DCA 200 may be configured so as to be selectively uncoupled (e.g., the lower section 10*b* from the upper section 10*a*, as disclosed herein) via the operation of the releasing member 300, as will also be disclosed herein. Referring to FIG. 4, an embodiment of the releasing member 300 is illustrated. As will be disclosed herein, the releasing member 300 may be generally configured to be displaced through the axial flowbore 126 so as to engage the DCA 200 (or a component thereof) so as to decouple the work string 202 from the casing string 204. In the embodiment of FIG. 4, the releasing member 300 generally comprises a releasing dart. In such an embodiment, the releasing member 300 generally comprises a body 310, a tail portion 320, and a nose portion 330.

In an embodiment, the body 310 may generally comprise a shaft having a relatively small diameter, for example, in comparison to the tail portion 320 and/or the nose portion 330. In an embodiment, the body 310 may be configured so as to allow the releasing member 300 to be displaced through a wellbore tubular, such as the work string 202. For example, in an embodiment, the body 310 may be characterized as exhibiting a desired and/or predetermined degree of flexibility. For example, the body 310 may be configured so as to be capable of bending or flexing, for example, so as to enable the releasing member 300 to traverse various bends, curves, or the like, while being displaced through a wellbore tubular.

In an embodiment, the releasing member 300 may be configured to sealingly and/or substantially sealingly engage an inner wall of a wellbore tubing string, such as, work string 202 (e.g., while displaced therethrough). For example, in the embodiment of FIG. 4, the body 310 of the releasing member 300 further comprises one or more wipers 315. In an embodiment, the wipers 315 may generally be configured to substantially engage an inner surface of a wellbore tubular. As will be appreciated by one of skill in the art viewing this disclosure, the wipers 315 may be sized to sealably and slidably engage the inner bore of a wellbore tubular, such as the work string 202, of a particular size. The wipers 315 may be provided in a suitable number and configuration, as will be appreciated by one of skill in the art viewing this disclosure. For example, the embodiment of FIG. 4 illustrates the releasing member 300 with four wipers, however more or fewer may be provided. The wipers 315 may extend radially outward from the body 310. For example, the wipers 315 may extend generally outward from the body 310 at a suitable angle from the body 310. For example, in the embodiment of the FIG. 4, each of the four wipers 315 is angled, thereby forming a downwardly-facing conical structure concentric about the body 310. In an embodiment, the wipers 315 may be formed from a suitable material. Such a suitable material may be characterized as conformable or pliable, for example, such that the wipers 315 may be able to conform to inconsistencies in the inner bore of the wellbore tubular when displaced therethrough. Examples of suitable materials include but are not limited to rubber, foam, plastics, elastomers, or combinations thereof.

In an embodiment, the tail portion 320 may generally comprise an upper or relatively uphole portion of the releasing member 300 (e.g., when the releasing member 300 is displaced through a wellbore tubular such as the work string 202). In an embodiment, the tail portion 320 may generally be configured to engage the releasing member retainer 18 within the upper section 10*a* of the DCA 200, for example, such that the releasing member 300 cannot be fully displaced through the DCA 200 (e.g., prohibited from passing through the releasing member retainer 18 of the DAC 200). For example, in such an embodiment, the tail portion 320 may be sized such that at a least a portion of the tail portion 320 comprises a diameter greater than the diameter of the releasing member retainer 18 (e.g., greater than the diameter of the bore surface 18*b* of the releasing member retainer 18). Also, in the embodiment of FIG. 4, the tail portion 320 generally comprises a downwardly-facing conical structure 321. In such an embodiment, the tail portion 320 may generally define an outer profile, at least a portion of which may be at least partially complementary to the inner profile defined by the releasing member retainer 18 (for example, a complementary seat or landing for tail portion 320).

In an embodiment, the tail portion 320 may be configured to allow a route of fluid communication from one side of the tail portion 320 (e.g., an uphole side) to the other side of the tail portion 320 (e.g., the downhole side), for example, when the tail portion engages the releasing member retainer 18 (e.g., when the releasing member 300 blocks and/or is disposed within the bore 18*b* of the releasing member retainer 18). For example, tail portion 320 may comprise one or more slots (alternatively, grooves, bores, notches, holes, channels, or the like) extending generally longitudinally through the tail portion 320. For example, where the releasing member engages the bevel 18*a* and/or bore 18*b* of the releasing member retainer 18, fluid may be communicated through such slots, grooves, bores, notches, channels, or the like, which may form a fluidic pathway between the uphole and downhole sides of the tail portion 320 of the releasing member 300, as will be disclosed herein.

In an embodiment, the nose portion 330 generally comprises a lower or relatively downhole portion of the releasing member 300 (e.g., when the releasing member 300 is displaced through a wellbore tubular such as the work string 202). In an embodiment, the nose portion 330 may be generally configured to engage the releasing sleeve 24 (e.g., to sealingly and/or substantially sealingly engage the releasing sleeve 24) within the lower section 10*b* of the DCA 200, for example, such that the nose portion 330 cannot pass through the releasing sleeve 24. For example, in such an embodiment, the nose portion 330 may be sized such that the nose portion 330 comprises a diameter less than the diameter of the of the releasing member retainer 18 (e.g., less than the diameter of the bore surface 18*b* of the releasing member retainer 18) and also such that the nose portion 330 (e.g., at least a portion of the nose portion 330) comprises a diameter greater than the diameter of the releasing sleeve 24 (e.g., greater than the diameter of the concentric bore 40 of the releasing sleeve 24. For example, in the embodiment of FIG. 4, the nose portion 330 generally comprises a first downwardly-facing conical structure 332, an outer bore surface 334, and a downwardly-facing shoulder or bevel 336. In such an embodiment, the nose portion 330 may generally define an outer profile, at least a portion of which may be at least partially complementary to the inner profile defined by the releasing sleeve 24 (e.g., a complementary landing seat for the nose portion 330). For example, the outer bore surface 334 and the downwardly-facing bevel 336 may be generally complementary to the bevel 42 and the concentric bore surface 40 of the releasing sleeve 24. Additionally, in an embodiment, the nose portion 330 and/or the releasing sleeve 24 may comprise one or more seals, such as O-rings or the lie, generally disposed about at least a portion of the nose portion, for example, so as form a substantially fluid-tight upon engaging the releasing sleeve 24, as will be disclosed herein.

One or more embodiments of a connection assembly (such as the DCA 200 disclosed herein) and/or a connection system (such as the connection system 100 disclosed herein), one or more embodiments of wellbore servicing methods utilizing such a connection assembly and/or such a connection system will also be disclosed.

In an embodiment, a wellbore servicing method (for example, a wellbore servicing method utilizing the DCA 200 and/or the connection system 100) generally comprises the steps of positioning a wellbore tubing string (particularly, a first wellbore tubing string selectively suspended from a second wellbore tubing string via the DCA 200) within a wellbore (such as the wellbore 114), selectively disconnecting the first wellbore tubing string from the second wellbore tubing string, and removing the second wellbore tubing string from the wellbore 114. As will be disclosed herein, upon removal of the second wellbore tubing string from the wellbore 114, the first wellbore tubing string will remain in the wellbore and be substantially free of obstructions to flow therethrough. As will also be disclosed herein, as the second wellbore tubing string is removed from the wellbore, fluid within the second wellbore tubing string may be substantially drained therefrom. Additionally, in an embodiment the wellbore servicing method may further comprise allowing a fluid to be produced from the subterranean formation via the first wellbore tubing string.

In an embodiment, a wellbore tubing string, for example, comprising a first wellbore tubing string selectively suspended from a second wellbore tubing string via the DCA 200. For example, in the embodiment of FIG. 1, a wellbore tubing string comprises a casing string (e.g., the casing string 204) selectively and releasably suspended from a work string (e.g., the work string 202). The work string 202 and the casing string 204 may be run into the wellbore 114 to a predetermined or desired depth, for example, such that the casing string 204 is positioned at a predetermined location (e.g., proximate and/or adjacent to one or more formation zones) within the wellbore 114. In an embodiment, a wellbore servicing tool (e.g., a stimulation tool) may be incorporated within the first wellbore tubing string (e.g., within the casing string 204). In such an embodiment, the wellbore tubing string(s) may be positioned such that the wellbore servicing tool is positioned at a predetermined location (e.g., proximate and/or adjacent to one or more formation zones).

In an embodiment, a fluid may be communicated through the wellbore tubing string(s) (e.g., forward-circulated, reverse-circulated, or combinations thereof) during the placement of the tubing string(s) within the wellbore 114 and/or to treat (e.g., stimulate) the wellbore/formation during and/or following placement.

In an embodiment, the first wellbore tubing string (e.g., the casing string 204) may be disconnected from the second wellbore tubing string (e.g., the work string 202), for example, after positioning the casing string 204, as disclosed herein. In an embodiment, disconnecting the casing string 204 from the work string 202 may generally comprise introducing a releasing member (such as the releasing member 300 disclosed herein) into the wellbore tubing string (e.g., the work string 202). For example, referring to FIG. 1, the releasing member 300 (e.g., a releasing dart) may be introduced into the work string 202 (the nose portion 330 first, followed by the tail portion 320). In an embodiment, the releasing member 300 may be released from the surface via the operation of a dart releasing assembly or the like; alternatively, the releasing member 300 may be released from a subsurface location.

In an embodiment, disconnecting the casing string 204 from the work string 202 may further comprise communicating the releasing member 300 through the work string 202 (e.g., pumping the dart downhole), for example, so as to engage the releasing sleeve 24 within the DCA 200, for example, as shown in FIG. 2B. For example, in an embodiment, the wipers 315 of the releasing member 300 may substantially sealingly engage the interior walls of the work string 202, for example, such that the downward circulation of fluid through via the axial flowbore 126 causes the releasing member 300 to move downwardly through the work string 202. In an embodiment, the releasing member 300 will be communicated through the work string to the DCA 200. Upon reaching the DCA 200, the nose portion 330 and the wipers 315 of the releasing member 300 will be transmitted through the releasing member retainer 18 (e.g., the nose portion 330 of the releasing member 300 may comprise an outermost diameter that is smaller than the diameter of the bore surface 18*b* of the releasing member retainer 18; likewise, the wipers may be generally flexible and, as such, will not inhibit the downward movement of the releasing member 300). The releasing member 300 may continue to move downwardly until the nose portion 330 of the releasing member 300 reaches and engages the releasing sleeve 24. For example, in such an embodiment, the nose portion 330 may sealingly engage the releasing sleeve 24 (e.g., the outer bore surface 334 and the downwardly-facing bevel 336 of the nose portion 330 may be generally complementary to the bevel 42 and the concentric bore surface 40 of the releasing sleeve 24, as disclosed herein). In an embodiment, DCA 200 and/or releasing member 300 may be configured such that the nose portion 330 reaches and engages the releasing sleeve 24 before the tail portion reaches and/or engages the releasing member retainer 18, as will be disclosed herein.

In an embodiment, disconnecting the casing string 204 from the work string 202 may further comprise applying a force to the releasing sleeve 24 via the releasing member 300. For example, with the releasing member 300 engaged (e.g., sealingly engaged) with the releasing sleeve 24, as disclosed herein, the application of force to the releasing member, for example, a hydraulic force, via a pressure exerted against the releasing member 300, may transmit a force to the releasing sleeve 24. Particularly, in such an embodiment, the application of such a force via the releasing member 300 may transmit a force to the releasing sleeve 24 in the direction of the second position. For example, such a force may cause the releasing sleeve 24 to exert a force against the shear pins 50, causing the shear pins 50 to fail (e.g., shear, break, sever, or otherwise cease to retain the releasing sleeve 24 in the first position). In an embodiment, continued application of such force to the releasing member 300 may cause the releasing sleeve 24 may continue to move in the direction of the second position (e.g., downward) until reaching the second position, for example, until the releasing sleeve 24 (e.g., a lower shoulder 48 of the releasing sleeve 24) engages the shoulder 37 of the collet, thereby restraining the releasing sleeve 24 from further, downward movement. In an embodiment, the DCA 200 and/or releasing member 300 may be configured such that the releasing sleeve 24 reaches the second position, as disclosed herein, before the tail portion reaches and/or engages the releasing member retainer 18, as will be disclosed herein.

Also in such an embodiment, the fluid pressure necessary to cause the releasing sleeve 24 to so-transition from the first position to the second may be characterized as being of at least a threshold pressure. In an embodiment, the threshold pressure may be at least about 250 psi, alternatively, about 500, alternatively, about 750 psi, alternatively, about 1,000 psi, alternatively, about 1,500 psi, alternatively, about 2,000 psi, alternatively, about 2,500 psi, alternatively, about 3,000 psi, alternatively, about 4,000 psi, alternatively, about 5,000 psi, alternatively, about 6,000 psi, alternatively, about 7,000 psi, alternatively, about 8,000 psi, alternatively, about 10,000 psi, alternatively, alternatively, about 12,000 psi, alternatively, about 14,000 psi, alternatively, about 16,000 psi, alternatively, about 18,000 psi, alternatively, about 20,000 psi, alternatively, any suitable pressure.

With the releasing sleeve 24 in the second longitudinal position, the collet 22 (e.g., the rim 80 of the collet 22) is not retained/held in the first radially expanded conformation. For example, upon transitioning the releasing sleeve 24 from the first longitudinal position to the second longitudinal position, the collet 22 (e.g., the rim 80 of the collet 22) may be allowed to the contract into the second, radially inward conformation, for example, such that the collet 22 is allowed to disengage the collet retainer 16. Particularly, as shown in the embodiment of FIG. 2C, the outwardly protruding rim 80 and/or the downward facing shoulder 81 of the collet 22 (e.g., the outer profile of the releasing collet 22) are allowed to disengage the first inner bore surface 64 and/or the bevel 65 of the collet retainer 16 (e.g., the inner profile of the collet retainer 16).

In an embodiment, for example, in an embodiment where the collet 22 (e.g., the plurality of collet fingers) is inwardly-biased, upon the movement of the releasing sleeve 24 from the first longitudinal position to the second longitudinal position, the collet 22 may contract into the second, radially inward conformation. Additionally or alternatively, in an embodiment, the collet 22 may contract radially inward upon the application of a longitudinal force to the DCA 200, for example, upon removing the second wellbore tubing string from the wellbore as will be disclosed herein. For example, as disclosed herein, in an embodiment the downward facing shoulder 81 of the collet 22 and/or the bevel 65 of the collet retainer 16 may comprise angled/beveled surfaces such that the application of a longitudinal, tensile force (e.g., a force pulling the upper section 10*a* and the lower section 10*b* in opposite directions) the interaction between the downward facing shoulder 81 and the bevel 65 may cause the collet 22 (e.g., the plurality of collet fingers) to flex inwardly to the second, radially inward conformation. As such, the outwardly protruding rim 80 and/or the downward facing shoulder 81 of the collet 22 (e.g., the outer profile of the releasing collet 22) are allowed to disengage the first inner bore surface 64 and/or the bevel 65 of the collet retainer 16 (e.g., the inner profile of the collet retainer 16), thereby allowing the lower section 10*b* of the DCA 200 to be disconnected from the upper section 10*a* thereof.

In an embodiment, upon disconnecting the lower section 10*b* from the upper section 10*a* and/or readying the lower section 10*b* to be disconnected from the upper section 10*a* (e.g., upon the application of a longitudinal, tensile force, as disclosed herein), the second wellbore tubing string (e.g., the work string 202) may be removed from the wellbore 114. In such an embodiment, removing the work string 202 from the wellbore 114 may generally comprising retracting the work string 202 toward the surface 104 (e.g., "running out" the work string 202) while the first wellbore tubing string (e.g., the casing string 204) remains positioned within the wellbore 114.

In an embodiment as shown in FIG. 2C, as the work string 202 is retracted (pulled upwardly) away from the casing string 204, the releasing member 300, particularly, the tail portion 320 of the releasing member 300, may engage the releasing member retainer 18. For example, the as the work string 202 (and upper section 10*a*) is pulled away from the casing string 204 (and lower section 10*b*), the, downward facing conical structure 321 of the tail portion 320 may engage the upper, conical bevel 18*a* of the releasing member retainer 18. As disclosed herein, the tail portion 320 is generally configured so as to engage the releasing member retainer 18, for example, such that the releasing member 300 cannot be fully displaced through the releasing member retainer 18. As such, in an embodiment, as the work string 202 is retracted (e.g., pulled upwardly), the engagement between the tail portion 320 and the releasing member retainer 18 pulls the releasing member 300 upwardly along with the work string 202, for example, thereby separating or disengaging the nose portion 330 of the releasing member from the releasing sleeve 24. As the work string 202 is pulled further up-hole away from the casing string 204, the releasing member 300 may also be pulled up-hole with the work string 202. As such, upon removing (e.g., fully or partially, upwardly retracting) the work string 202, the releasing member 300 will be removed from the lower section 10*b* of the DCA 200, for example, so that the releasing member 300 (nor any portion thereof) blocks, obscures, or remains within any portion of the lower section 10*b*. As such, upon removing and/or retracting the work string 202, the lower portion of the axial flow bore 26*b* is unobstructed by the releasing member 300 (or any other, like obturating member associated with the operation of the DCA 200).

Additionally, in an embodiment, as the work string 202 is removed from the wellbore 114, the DCA 200 and/or the releasing member 300 may be configured so as to allow fluid within the axial flowbore 126 of the work string to be drained therefrom. For example, in an embodiment as disclosed herein, the releasing member retainer 18 and/or the tail portion 320 of the releasing member 300 may comprise one or more slots, grooves, bores, notches, holes, channels, or the like (e.g., slots 18*c*) that allow fluid to pass from the uphole to the downhole side of the releasing member retainer 18 and out of the work string 202, for example, even though the releasing member 300 engages the releasing member retainer 18 within the upper portion 10*a* of the DCA 200 (which is coupled to the lower-most end of the work string 202). As such, fluid may be drained from the work string 202 during run-out of the work string 202 and the upper section 10*a* of the DCA 200.

In an embodiment, a DCA (like DCA 200), a system utilizing such a DCA, and/or a method utilizing such a DCA may be advantageously employed in the performance of a wellbore servicing operation. For example, as disclosed herein, the DCA allows for an operator to dispose a first wellbore tubular within a wellbore (e.g., such as a horizontal wellbore portion, for example, penetrating a coal seam) and decouple the first wellbore tubular from a second wellbore tubular. Particularly, the DCA allows for the first wellbore tubular (e.g., which is disposed within the wellbore) to be open-ended and/or unobstructed (for example, by a dart or a plug), thereby providing a flow path for fluids (e.g., for production of a formation fluid). For example, utilizing such a DCA, a perforated tubing string may be disposed within a wellbore to prevent collapse of the wellbore while providing a relatively unobstructed flow path for gas production (e.g., coal bed method). Additionally, the DCA allows an operator to decouple the two wellbore tubulars without the need for utilizing conventional liner hanger disconnect tools and/or without the need for drilling-out the wellbore tubular that remains in the wellbore, for example, decreasing the time associated with such operations.

Further still, a DCA as disclosed herein allows for fluid to be drained out of the disconnected end of the second wellbore tubular (such as the work string, as disclosed herein) as the second wellbore tubular is removed from the wellbore. As a result, because fluid is drained prior to being disconnected at the surface (e.g., during run-out), workers may benefit from a safer working environment due to the absence of such fluids and/or associated pressures in the work area. Additionally, this allows run-out to take place more quickly and efficiently.

ADDITIONAL DESCRIPTION OF THE EMBODIMENTS

The following are non-limiting, specific embodiments in accordance with the present disclosure:

A first embodiment, which is a wellbore servicing method comprising:

positioning a wellbore tubing string within a wellbore, wherein the wellbore tubing string comprises a lower wellbore tubular coupled to an upper wellbore tubular via a disconnectable assembly having a lower section connected to the lower wellbore tubular and an upper section connected to the upper wellbore tubular;

disconnecting the lower wellbore tubular from the upper wellbore tubular via the disconnectable assembly, wherein disconnecting the lower wellbore tubular from the upper wellbore tubular comprises:

introducing a releasing member into the upper wellbore tubular; and conveying the releasing member through the upper wellbore tubular to engage the disconnectable assembly; and retracting the upper wellbore tubular upwardly within the wellbore, wherein upon retracting the upper wellbore tubular, the releasing member is retracted along with the upper section of the disconnectable assembly, and wherein upon retracting the upper wellbore tubular, a route of fluid communication out of the upper wellbore tubular is provided.

A second embodiment, which is the wellbore servicing method of the first embodiment, wherein the upper section of the disconnectable assembly comprises a collet retainer, and wherein the lower section of the disconnectable assembly comprises a collet and a releasing sleeve.

A third embodiment, which is the wellbore servicing method of one of the first through second embodiments, wherein conveying the releasing member through the upper wellbore tubular to engage the disconnectable assembly comprises conveying the releasing member through the upper wellbore tubular to engage the releasing sleeve.

A fourth embodiment, which is the wellbore servicing method of the third embodiment, further comprising applying a force to the releasing sleeve via the releasing member so as to transition the releasing sleeve from a first position to a second position.

A fifth embodiment, which is the wellbore servicing method of the fourth embodiment, wherein transitioning the releasing sleeve from the first position to the second position allows at least a portion of the collet to contract radially inward.

A sixth embodiment, which is the wellbore servicing method of the fifth embodiment, wherein contracting radially inward allows the collet to disengage the collet retainer.

A seventh embodiment, which is the wellbore servicing method of one of the first through sixth embodiments, wherein upon retracting the upper wellbore tubular, a tail portion of the releasing member engages a releasing member retainer within the upper section of the disconnectable assembly.

An eighth embodiment, which is the wellbore servicing method of the seventh embodiment, wherein the releasing member retainer comprises a seat engaging the tail portion of the releasing member.

A ninth embodiment, which is the wellbore servicing method of one of the seventh through eighth embodiments, wherein the releasing member retainer, the tail portion of the releasing member, or combinations thereof comprises a route of fluid communication therethrough.

A tenth embodiment, which is a wellbore connection system comprising:

a first wellbore tubular;

a second wellbore tubular;

a disconnectable assembly comprising:

a lower section, wherein the upper section is coupled to the first wellbore tubular; and an upper section, wherein the upper section is coupled to the second wellbore tubular, and wherein the lower section is selectively, disconnectably coupled to the upper section;

a releasing member configured to uncouple the lower section from the upper section, wherein the disconnectable assembly and/or the releasing member is configured such that upon uncoupling the lower section from the upper section, the releasing member is at least partially retained by the upper section, and wherein the disconnectable assembly and/or the releasing member is configured so as to provide a route of fluid communication upon uncoupling the lower section from the upper section.

An eleventh embodiment, which is the wellbore connection system of the tenth embodiment, wherein the upper section of the disconnectable assembly comprises a collet retainer, and wherein the lower section of the disconnectable assembly comprises a collet and a releasing sleeve.

A twelfth embodiment, which is the wellbore connection system of the eleventh embodiment, wherein disconnectable assembly is configured such that:

in a first position, the releasing sleeve retains the collet in a radially expanded conformation, and in a second position, the releasing sleeve allows the collet to contract into a radially contracted conformation.

A thirteenth embodiment, which is the wellbore servicing system of the twelfth embodiment, wherein, in the radially expanded conformation, the collet engages the collet retainer, and wherein, in the radially contracted conformation, the collet releases the collet retainer.

A fourteenth embodiment, which is the wellbore servicing system of one of the tenth through thirteenth embodiments, wherein the upper section of the disconnectable assembly comprises a releasing member retainer, wherein the releasing member retainer allows a nose portion and a body of the releasing member to pass therethrough and retains a tail portion of the releasing member.

A fifteenth embodiment, which is the wellbore servicing system of one of the tenth through fourteenth embodiments, wherein the first wellbore tubular comprises a casing string.

A sixteenth embodiment, which is the wellbore servicing system of the fifteenth embodiment, wherein the casing string is perforated.

A seventeenth embodiment, which is the wellbore servicing system of one of the tenth through sixteenth embodiments, wherein the second wellbore tubular comprises a work string.

An eighteenth embodiment, which is a wellbore connection system comprising:

a first wellbore tubular, the first wellbore tubular disposed in an upper portion of a wellbore;

a lower section of a dissconnectable assembly, wherein the lower section is coupled to the first wellbore tubular; and a second wellbore tubular, the second wellbore tubular disposed in an upper portion of the wellbore;

an upper section of the disconnectable assembly, wherein the upper section is coupled to the second wellbore tubular; and a releasing member, wherein the releasing member is at least partially retained by the upper section of the disconnectable assembly.

A nineteenth embodiment, which is the wellbore connection system of the eighteenth embodiment, wherein the upper section of the disconnectable assembly comprises a collet retainer, and wherein the lower section of the disconnectable assembly comprises a collet and a releasing sleeve.

A twentieth embodiment, which is the wellbore connection system of the nineteenth embodiment, wherein disconnectable assembly is selectively configurable from:

a first position, wherein the releasing sleeve retains the collet in a radially expanded conformation, and a second position, wherein the releasing sleeve allows the collet to contract into a radially contracted conformation.

A twenty-first embodiment, which is the wellbore connection system of the twentieth embodiment, wherein, in the radially expanded conformation, the collet engages the collet retainer, and wherein, in the radially contracted conformation, the collet releases the collet retainer.

A twenty-second embodiment, which is the wellbore connection system of one of the eighteenth through twenty-first embodiments, wherein the upper section of the disconnectable assembly comprises a releasing member retainer, wherein the releasing member retainer allows a nose portion and a body of the releasing member to pass therethrough and retains a tail portion of the releasing member.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A wellbore servicing method comprising:

positioning a wellbore tubing string within a wellbore, wherein the wellbore tubing string comprises a lower wellbore tubular coupled to an upper wellbore tubular via a disconnectable assembly having a lower section connected to the lower wellbore tubular and an upper section connected to the upper wellbore tubular, wherein the upper section of the disconnectable assembly comprises a collet retainer, and wherein the lower section of the disconnectable assembly comprises a collet and a releasing sleeve;

disconnecting the lower wellbore tubular from the upper wellbore tubular via the disconnectable assembly, wherein disconnecting the lower wellbore tubular from the upper wellbore tubular comprises:

introducing a releasing member into the upper wellbore tubular;

conveying the releasing member through the upper wellbore tubular to engage the releasing sleeve of the disconnectable assembly; and applying a force to the releasing sleeve via the releasing member so as to transition the releasing sleeve from a first position to a second position, wherein transitioning the releasing sleeve from the first position to the second position allows at least a portion of the collet to contract radially inward, wherein the releasing sleeve reaches the second position before a tail portion of the releasing member engages a releasing member retainer within the upper section of the disconnectable assembly; and retracting the upper wellbore tubular upwardly within the wellbore, wherein upon retracting the upper wellbore tubular, the releasing member is retracted along with the upper section of the disconnectable assembly, and wherein upon retracting the upper wellbore tubular, a route of fluid communication out of a disconnected end of the upper wellbore tubular is established.

2. The wellbore servicing method of claim 1, wherein contracting radially inward allows the collet to disengage the collet retainer.

3. The wellbore servicing method of claim 1, wherein upon retracting the upper wellbore tubular, the tail portion of the releasing member engages the releasing member retainer within the upper section of the disconnectable assembly.

4. The wellbore servicing method of claim 3, wherein the releasing member retainer comprises a seat engaging the tail portion of the releasing member.

5. The wellbore servicing method of claim 3, wherein the releasing member retainer comprises a fluidic pathway formed between an uphole side and a downhole side of the releasing member retainer.

6. The wellbore servicing method of claim 3, wherein the tail portion of the releasing member comprises one or more fluidic pathways extending longitudinally through the tail portion.

7. A wellbore connection system comprising:

a first wellbore tubular;

a second wellbore tubular;

a disconnectable assembly comprising:

a lower section, wherein the lower section comprises a collet and a releasing sleeve, and is coupled to the first wellbore tubular; and an upper section, wherein the upper section comprises a collet retainer and a releasing member retainer, and is coupled to the second wellbore tubular, and wherein the lower section is selectively, disconnectably coupled to the upper section;

a releasing member configured to be conveyed through the second wellbore tubular to engage the releasing sleeve, wherein the releasing member is configured to uncouple the lower section from the upper section by applying a force to the releasing sleeve so as to transition the releasing sleeve from a first position to a second position, wherein transitioning the releasing sleeve from the first position to the second position allows at least a portion of the collet to contract radially inward, wherein the disconnectable assembly and/or the releasing member is configured such that in the second position, the releasing sleeve allows the collet to contract into a radially contracted conformation, and upon uncoupling the lower section from the upper section, the releasing member is at least partially retained by the upper section, and wherein the disconnectable assembly and/or the releasing member is configured so as to establish a route of fluid communication out of a disconnected end of the upper section upon retraction of the second wellbore tubular; and wherein, upon the releasing member applying a force to transition the releasing sleeve from the first position to the second position, the releasing sleeve reaches the second position before a tail portion of the releasing member engages the releasing member retainer.

8. The wellbore connection system of claim 7, wherein disconnectable assembly is configured such that:

in the first position, the releasing sleeve retains the collet in a radially expanded conformation, and in the second position, the releasing sleeve allows the collet to contract into a radially contracted conformation.

9. The wellbore servicing system of claim 8, wherein, in the radially expanded conformation, the collet engages the collet retainer, and wherein, in the radially contracted conformation, the collet releases the collet retainer.

10. The wellbore servicing system claim 7, wherein the releasing member retainer allows the nose portion and a body of the releasing member to pass therethrough and retains the tail portion of the releasing member.

11. The wellbore servicing system of claim 7, wherein the first wellbore tubular comprises a casing string.

12. The wellbore servicing system of claim 11, wherein the casing string is perforated.

13. The wellbore servicing system of claim 7, wherein the second wellbore tubular comprises a work string.

14. The wellbore connection system of claim 7, wherein the disconnectable assembly and/or the releasing member is configured so as to initially establish the route of fluid communication out of the disconnected end of the upper section after the lower and upper sections are disconnected from each other.

15. The wellbore connection system of claim 7, where upon retracting the upper wellbore tubular, the tail portion of the releasing member engages the releasing member retainer within the upper section of the disconnectable assembly.

16. The wellbore connection system of claim 15, wherein the releasing member retainer comprises a seat for engaging the tail portion of the releasing member.

17. The wellbore connection system of claim 15, wherein the releasing member retainer comprises a fluidic pathway formed between an uphole side and a downhole side of the releasing member retainer.

* * * * *